United States Patent [19]

VanKirk

[11] 4,358,934

[45] Nov. 16, 1982

[54] ATMOSPHERIC AIR INTAKE APPARATUS FOR COOLERS

[76] Inventor: Raymond J. VanKirk, 5370 Folks Rd., Horton, Mich. 49246

[21] Appl. No.: 295,751

[22] Filed: Aug. 24, 1981

[51] Int. Cl.[3] ..... F25D 17/00

[52] U.S. Cl. ..... 62/180; 62/203; 62/409; 62/412; 165/16; 236/49

[58] Field of Search ..... 62/409, 412, 180, 203; 236/49; 165/16

[56] References Cited

U.S. PATENT DOCUMENTS

| | | | |
|---|---|---|---|
| 1,600,522 | 9/1926 | Strehlke | 62/409 |
| 1,693,200 | 11/1928 | Flint | 62/412 |
| 2,216,873 | 10/1940 | Browne | 62/412 |
| 4,023,947 | 5/1977 | Ferry | 62/180 |
| 4,175,401 | 11/1979 | McManus | 62/412 |
| 4,178,770 | 12/1979 | Fox | 62/412 |
| 4,250,716 | 2/1981 | Huffman | 62/180 |

*Primary Examiner*—Ronald C. Capossela
*Attorney, Agent, or Firm*—Beaman & Beaman

[57] ABSTRACT

The invention pertains to apparatus for utilizing atmospheric air to cool enclosures, such as refrigerated coolers, computer rooms, and other spaces requiring temperature regulation of cool air. A panel mounted within the enclosure to be cooled includes an atmospheric air grill inlet communicating through an air duct with an air supply fan located within atmospheric air for forcing cool atmospheric air through the grill. The panel also includes an interior exhaust fan within the enclosure communicating with an air duct for exhausting enclosure air to atmosphere, and temperature sensing control means for both fans sense the temperature within the enclosure and that of the atmospheric air to simultaneously actuate the air supply and exhaust fans which are of substantially equal air flow capacity wherein the air pressure within the enclosure remains substantially constant while supplying cool atmospheric air thereto.

5 Claims, 5 Drawing Figures

ATMOSPHERIC AIR INTAKE APPARATUS FOR COOLERS

BACKGROUND OF THE INVENTION

Enclosures which are to be maintained at relatively low predetermined temperature conditions normally utilize conventional refrigeration systems employing compressors, and condenser and evaporator coils, wherein heat is removed from the enclosures to be cooled by the evaporator through the operation of the conventional refrigeration cycle. Coolers, such as used in restaurants, grocery stores, and the like which are of relatively large size and of the "walk-in" type require refrigeration apparatus of relatively high capacity utilizing large compressor motors of several horse power. With increasing electrical power rates, the cost of operating such refrigeration circuits is becoming increasingly expensive and the owners of such coolers are anxious to reduce operating costs, if possible.

In northern climates outdoor atmospheric temperatures are often below 40° F. during significant portions of the year, and as the temperature within many coolers is approximately 40° F. during normal conditions ambient atmospheric air could be used for cooling purposes, rather than the usual refrigeration circuit, if apparatus is available for efficiently introducing the ambient atmospheric air into the enclosure to be cooled without creating undesirable effects within the cooler and wherein the temperature within the cooled enclosure can be accurately maintained within close tolerances. Cool atmospheric air has been utilized for refrigeration purposes for many years, and it is also known to use electric fans for drawing atmospheric air into a cooler, examples of such installations being shown in U.S. Pat. Nos. 1,693,200 and 1,600,522, respectively. Also, U.S. Pat. No. 2,216,873 discloses a cooled enclosure utilizing ambient air for cooling, thermostatic valves being employed to control the air movement.

More sophisticated apparatus for introducing ambient atmospheric air into an enclosure to be cooled is shown in U.S. Pat. Nos. 4,023,947 and 4,250,716, and these patents disclose electrical circuits controlling fans for the introduction of ambient atmospheric air into the enclosure which are also correlated to the conventional refrigeration control circuit such that the auxiliary ambient air cooling system is only utilized when the atmospheric air is below a predetermined temperature, such as 40° F., and at higher ambient temperatures cooling will be produced by the refrigeration circuit in the conventional manner. With auxiliary ambient air cooling systems such as shown in the aforementioned patents, it has been found that the placing of the ambient air supply fan within the enclosure to "draw" the ambient air into the enclosure severely limits the efficiency and capacity of the apparatus in that the length of the fan inlet duct must be relatively great, and high air frictional resistance is encountered, substantially reducing the effective capacity of the auxiliary cooling system.

A further deficiency of the prior art devices results from the fact that auxiliary cooling systems introducing ambient air into the cooled enclosure do not provide for the exhausting of an equal amount of air therefrom in order to prevent a superatmospheric pressure within the enclosure being cooled. Thus, a superatmospheric pressure is produced within the enclosure causing an excessive loss of cool air when the enclosure doors are opened, and also producing undesirable door action and movement, tending to open, and maintain the door open, and complicate door latching and closing.

It is an object of the invention to provide apparatus for utilizing cool ambient atmospheric air for cooling an enclosure wherein the apparatus is readily installable in existing structure, and wherein a wide variety of installations may be accomodated without adversely affecting the efficiency of the apparatus.

A further object of the invention is to provide apparatus for utilizing ambient atmospheric air for cooling wherein the atmospheric air is forced into the enclosure to be cooled, rather than drawn therein, assuring a high efficiency of air handling and transfer regardless of the wall thickness of the enclosure or other unusual installation characteristics.

An additional object of the invention is to provide apparatus for utilizing ambient atmospheric air for cooling wherein atmospheric air is introduced into the cooled enclosure at a rate substantially equal the rate air is exhausted therefrom wherein the pressure within the cooled enclosure remains substantially normal during operation of the apparatus.

Yet another object of the invention is to provide apparatus for utilizing ambient exterior atmospheric air for cooling purposes wherein a preassembled panel is located within the cooled enclosure communicating with air ducts formed in the enclosure wall whereby a professional and attractive appearance is maintained, and wherein installation can be achieved without requiring unusual skills.

In the practice of the invention a pair of spaced, substantially parallel, openings are formed in the wall of the enclosure to be cooled wherein the openings communicate with the ambient atmospheric air. Insulated ducts are located within the openings, and the duct's inner ends communicate with air inlet and outlet openings defined in a panel attached to the inner wall of the enclosure. The panel includes an aligned inlet opening having a grill disposed thereover whereby cool ambient air may pass therethrough into the enclosure, and the panel outlet, or exhaust opening, is aligned with an exhaust fan mounted upon the panel for displacing air from the enclosure through self-closing louvres formed in the panel outlet opening into the aligned air duct. Temperature sensing control means are mounted upon the panel intermediate the air inlet and outlet opening, and the control means include temperature sensing bulbs within the enclosure and also sensing the exterior ambient atmospheric air wherein, upon predetermined temperature conditions existing within the enclosure, and within the atmospheric air, simultaneous operation of an air supply fan and the exhaust fan occurs.

A housing is located at the outer end of the air duct communicating with the panel inlet opening, and an air supply fan is located therein in communication with the associated air duct. A filter within the housing filters air drawn therein by the air supply fan wherein the filtered air is forced into the air duct and through the panel grill into the enclosure being cooled.

A weather shield is mounted upon the outer end of the other air duct communicating with the exhaust fan, and the weather shield includes a screen preventing insects, birds, and foreign matter from entering the associated air duct, and the shield includes a downwardly disposed opening through which exhausted air passes.

As the air flow capacities of the air supply fan and the exhaust fan are substantially equal, and as these fans operate simultaneously, the introduction of cooled ambient atmospheric air into the enclosure while simultaneously exhausting air therefrom at an equal rate prevents a superatmospheric pressure from occurring within the enclosure resulting in a high air flow efficiency through both fans, and preventing problems which arise when a superatmospheric pressure, even though small, exists within the cooled enclosure.

BRIEF DESCRIPTION OF THE DRAWINGS

The aforementioned objects and advantages of the invention will be appreciated from the following description and accompanying drawings wherein.

DESCRIPTION OF THE PREFERRED EMBODIMENT

The apparatus of the invention will usually be employed to cool a large refrigerator or walk-in cooler, as commonly found in grocery stores, restaurants and similar commercial establishments. However, it is to be understood that the disclosed apparatus may be utilized in any environment wherein close temperature control of cool air is required, such as used in computer rooms and other spaces wherein high technology equipment requires cool temperatures for assuring efficient and long-lasting operation.

Of course, auxiliary cooling apparatus of the type disclosed is only practical when utilized in climates wherein the ambient exterior atmospheric air, at least for a portion of the year, is below the temperature to be maintained within the cooled enclosure. For instance, apparatus of the disclosed type can be economically utilized at many locations located in the upper half of the United States, and also at higher altitudes in more southern locations wherein cool temperatures often exist.

Figure 2:
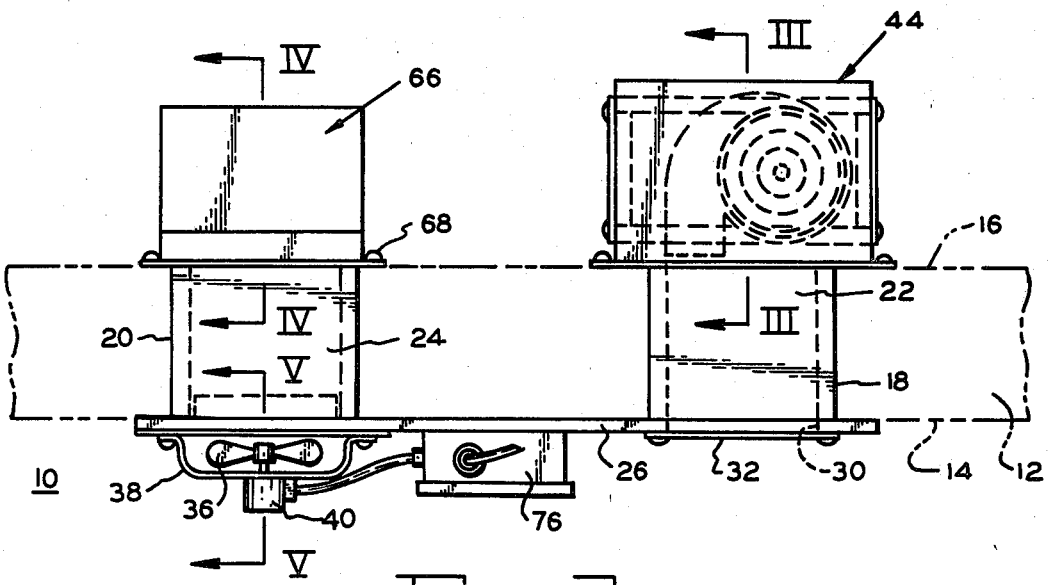
FIG. 2 is a top plan view of the apparatus of the invention, the wall of the enclosure being shown in phantom lines.

The enclosure being cooled will constitute a room defined by thermally insulated walls, and the enclosure is generally indicated at 10, in FIG. 2. An enclosure wall is indicated at 12, and includes an inner surface 14 disposed toward the enclosure, and an outer surface or side 16 which is exposed to the ambient exterior atmospheric air. The wall 12 is shown in a simplified form, and will include thermally insulated material disposed adjacent the inner surface 14, and a masonry or frame construction may constitute the remainder of the wall.

To utilize the disclosed cooling apparatus the wall 12 includes openings 18 and 20 extending therethrough intersecting the wall inner and outer surfaces. The openings 18 and 20 are preferably of a rectangular cross section, and when installing the apparatus of the invention in existing enclosures the openings can be readily formed in the wall by conventional tools.

Each of the openings is lined with an insulated rectangular air duct having a cross sectional configuration corresponding to, and slightly less, than the wall opening in which it is located. The air ducts 22 and 24 are preferably formed of preshaped fiberglass compositions, having a wall thickness of an inch or so. Each air duct includes an inner end disposed adjacent the wall inner surface 14, and an outer end disposed adjacent the wall outer surface 16.

Figure 1:
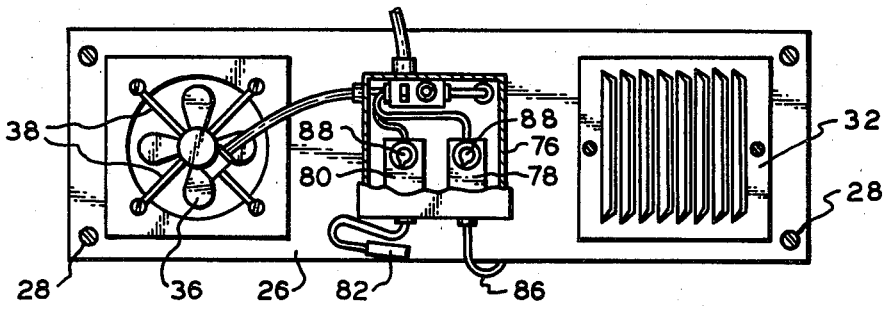
FIG. 1 is an elevational view of the panel of apparatus of the invention, a portion of the control housing being broken away for purpose of illustration.

A rectangular panel 26 is mounted upon the enclosure wall inner surface 14 by suitable fasteners, such as bolts 28, FIG. 1, and the panel may be formed of a synthetic plastic material, wood, metal, or other relatively rigid composition. The panel 26 includes a supply air inlet opening 30 of rectangular configuration corresponding to the size and shape of the air duct 22, and is in alignment therewith. A grill 32, FIGS. 1 and 2, is mounted upon the panel 26 by screws, superimposed over the panel opening 30, whereby air supplied to the duct 22 passes through the grill 32 into the enclosure 10. The grill includes louvres which may be obliquely oriented to direct the air flow therethrough in a desired direction.

Figure 5:
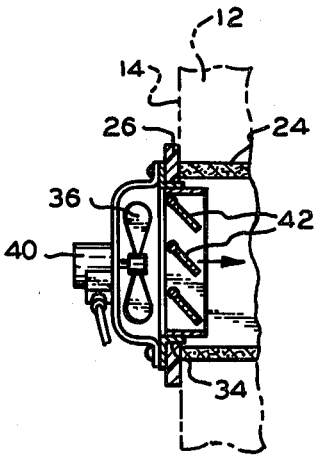
FIG. 5 is an elevational, sectional, detail view of the exhaust fan structure as mounted upon the panel and taken along Section V—V of FIG. 2.

The panel 26 also includes an exhaust air opening 34, FIG. 5, which is of similar dimension and configuration as the air duct 24, and is in alignment therewith. An axial exhaust fan 36 is mounted upon the panel 26 within the enclosure 10 upon brackets 38, and the fan is driven by electric motor 40. The fan assembly includes self-closing louvres 42 mounted within the panel exhaust opening 34, and the louvres 42 are pivotally mounted in the known manner to open automatically upon energization of the fan motor permitting exhaust air to enter the duct 24. Upon the fan motor being deenergized the louvres 42 will self close preventing the flow of air through the duct 24.

Figure 3:
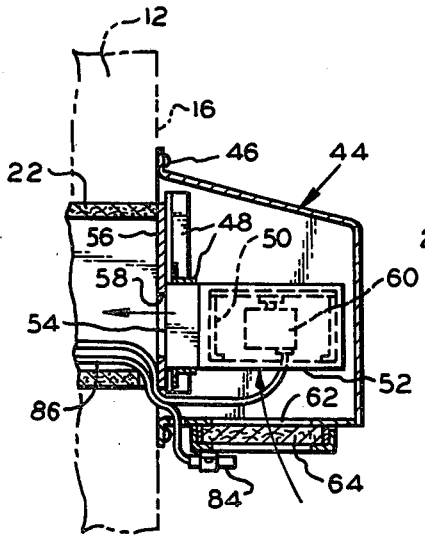
FIG. 3 is an elevational, detail, sectional view taken through the air supply housing along Section III—III of FIG. 2.

A sheet metal housing or bonnet 44 is mounted upon the wall outer surface 16 by fasteners 46, and the housing includes an obliquely disposed roof section for rain shedding purposes. The housing 44 includes a bracket 48 on which the air supply fan 50 is mounted, the fan being of a squirrel cage type having an inlet at 52, and an outlet at 54, FIG. 3, and a plate 56 disposed over the end of air duct 22 includes an opening 58, FIG. 3, defined therein of a size corresponding to the fan outlet 54 and in alignment therewith to close the end of duct 22. The fan 50 is powered by electric motor 60, FIG. 3.

At its lower panel, an opening 62 is defined in the housing 44, over which a filter 64 is disposed, the filter 64 preventing dust and other small particles of foreign matter from entering the housing 44 and being forced by the air supply fan into the enclosure 10.

Figure 4:
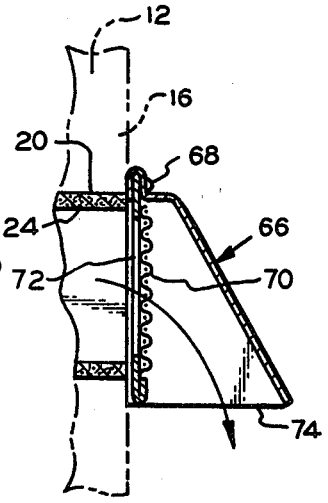
FIG. 4 is an elevational, detail, sectional view taken through the weather shield along Section IV—IV of FIG. 2.

A sheet metal weather shield 66 is attached to the wall outer surface 16 by fasteners 68, and the weather shield also includes an oblique upper surface for shedding rain and snow. A screen 70 covers the weather shield opening 72 which is in alignment with and in communication with the duct 24 preventing insects, birds, and the like from entering the duct, and the lower portion of the weather shield is open at 74, FIG. 4, whereby air exhausting from the duct 24 is deflected downwardly.

The controls for the air supply fan 50 and the exhaust fan 36 are mounted within a control box 76 centrally located upon the panel 26 between the grill 32 and the exhaust fan. The controls include adjustable temperature sensing switches 78 and 80, and switch 80 includes a sensing bulb 82, FIG. 1, which senses the temperature with the enclosure 10, and a sensing bulb 84 is mounted below the housing 44, FIG. 3, and is connected to the switch 78 by the capillary tube 86 which extends through the air duct 22. The bulb 82 senses the exterior ambient atmospheric temperature.

The switches 78 and 80 are of a conventional design whereby the upper and lower temperature contact operating limits may be readily adjusted by a knob 88 defined upon the switch for adjustment by the user. For instance, switch 78 is set to determine the maximum atmospheric air temperature at which the apparatus will be utilized, while switch 80 is set at the desired temperature for the enclosure 10, and the switch 80 will cycle the fans 36 and 50 to maintain the desired enclosure temperature when using atmospheric air for cooling.

In operation, the apparatus will be installed as illustrated in the drawings. The thermostatic switch 80 will be adjusted to match the thermostatic controls on the existing compressor operated refrigeration equipment, and it is to be understood that the conventional compressor operated refrigeration equipment within the enclosure 10 is not modified in any manner when utilizing the apparatus of the invention.

Assuming the ambient atmospheric air to be at a sufficiently low temperature as sensed by bulb 84 and switch 78, a rise in temperature within the enclosure 10 will cause switch 80 to close which simultaneously energizes air supply fan 40 and exhaust fan 36. The fan 50 will draw air into the housing 44 through the filter 64, and force air into duct 22 and into the enclosure 10 through the grill 32. Simultaneously, air will be exhausted from the enclosure 10 by the exhaust fan 36, whose energizing will open the louvres 42, FIG. 5, and exhaust air through the duct 24 and the weather shield opening 74. The panel 26 is mounted upon the wall 12 relatively close to the enclosure ceiling whereby the warmest air within the enclosure will be exhausted therefrom by fan 36. Of course, the cool air entering the enclosure 10 will "fall" to the lower regions of the enclosure due to its higher density, and accordingly, the mounting of the air supply and exhaust fans at a common horizontal location will not result in the cool air supply being immediately exhausted from the enclosure, especially as the grill 32 directs incoming air away from the exhaust fan. Upon the atmospheric air cooling the enclosure 10 to the "low" setting of switch 80 the fans will be deenergized, and cycling of the fans will continue to maintain the enclosure at the desired temperature without requiring operation of the compressor operated refrigeration circuit.

If the ambient atmospheric air temperature is too high to be introduced into the enclosure 10, such ambient temperature is sensed by the switch 78, and the circuit to the fans 36 and 50 is deenergized. Thus, upon the temperature within the enclosure 10 rising only the compressor operated refrigeration cycle will be energized to cool the enclosure in the usual manner.

As the air flow capacities of the air supply fan 50 and the exhaust fan 36 are substantially equal the injecting of ambient air into the enclosure 10 will not produce a superatmospheric pressure within the enclosure in view of the simultaneous operation of the exhaust fan. The maintaining of the normal air pressure within the enclosure 10 prevents the cool air within the enclosure from being "forced" from the enclosure, particularly when the access door of a walk-in cooler is open, and further, the enclosure door will not be held ajar, or its operation otherwise adversely affected by a superatmospheric air pressure. Further, the exhausting of the air from the enclosure while simultaneously supplying atmospheric cool air thereto, assures an efficient operation of the supply fan 50 by the removal of any "back pressure" within the enclosure.

During summer months when the apparatus of the invention will not be employed due to high ambient atmospheric air temperatures the air ducts 22 and 24 may be temporarily plugged by inserting thermally insulated plugs of fiberglass material therein, not shown, if it is desired to prevent all heat loss through the ducts.

It will be appreciated that modifications to the inventive concepts may be apparent to those skilled in the air without departing from the spirit and scope of the invention.

I claim:

1. Apparatus for utilizing exterior atmospheric air for cooling an enclosure having an inner surface comprising, in combination, a panel, means for mounting said panel upon the enclosure inner surface, an atmospheric air inlet defined in said panel, an enclosure air exhaust outlet defined in said panel spaced from said inlet, an electric exhaust fan mounted upon said panel for direct communication with the enclosure for selectively exhausting air through said exhaust outlet, a first air duct having a first end in alignment with and communicating with said panel inlet and a second end in communication with atmospheric air, an electric atmospheric air supply fan having an outlet in communication with said first air duct at said second end and located within the atmospheric air, a second air duct having a first end in alignment with and in communication with said exhaust outlet and a second end in communication with the atmospheric air, said exhaust and air supply fans having substantially equal air flow rates, and air temperature responsive fan control means electrically connected to said air supply and exhaust fans sensing the enclosure and atmospheric air temperatures to simultaneously energize said fans at predetermined enclosure and atmospheric temperature conditions.

2. Apparatus for utilizing exterior atmospheric air for cooling an enclosure as in claim 1 wherein said fan control means is mounted upon said panel intermediate said panel air inlet and exhaust outlet.

3. Apparatus for utilizing exterior atmospheric air for cooling an enclosure as in claim 1, a grill mounted upon said panel disposed over said panel air outlet.

4. Apparatus for utilizing exterior atmospheric air for cooling an enclosure as in claim 1, a plurality of self-opening and self-enclosing louvres mounted upon said panel within said air exhaust outlet, said louvres opening upon said exhaust fan being energized and closing upon said exhaust fan being deenergized.

5. Apparatus for utilizing exterior atmospheric air for cooling an enclosure as in claim 1, a housing located within the atmospheric air in alignment with and communicating with said first air duct second end, said atmospheric air supply fan being located within said housing and drawing air thereinto, and an air filter defined on said housing filtering the air drawn into said housing by said air supply fan.

* * * * *